United States Patent [19]

Nierenberg

[11] Patent Number: 4,979,920

[45] Date of Patent: Dec. 25, 1990

[54] SYSTEM FOR MEASURING Q SPACING IN A KINESCOPE PANEL

[75] Inventor: Mort J. Nierenberg, Lancaster, Pa.

[73] Assignee: Thomson Consumer Electronics, Inc., Indianapolis, Ind.

[21] Appl. No.: 397,202

[22] Filed: Aug. 23, 1989

[51] Int. Cl.[5] ..... H01J 9/44

[52] U.S. Cl. ..... 445/64; 445/3

[58] Field of Search ..... 445/3, 30, 37, 63, 64; 364/460, 560, 562, 561; 73/597, 601

[56] References Cited

U.S. PATENT DOCUMENTS

| | | | |
|---|---|---|---|
| 3,537,161 | 11/1970 | Kautz | 445/30 |
| 4,190,936 | 3/1980 | Van Renssen | 445/30 |
| 4,307,337 | 12/1981 | van den Berg et al. | 324/61 |
| 4,593,368 | 6/1986 | Fridge et al. | 364/561 |
| 4,758,728 | 7/1988 | Matey et al. | 445/63 |
| 4,850,921 | 7/1989 | Hama et al. | 445/63 |

FOREIGN PATENT DOCUMENTS

| | | | |
|---|---|---|---|
| 62-211830 | 9/1987 | Japan | 445/63 |

*Primary Examiner*—Hezron E. Williams
*Assistant Examiner*—Louis M. Arana
*Attorney, Agent, or Firm*—J. S. Tripoli; D. H. Irlbeck; L. L. Hallacher

[57] ABSTRACT

A system for measuring the Q spacing of a kinescope panel without removing the mask from the panel includes an adder which stores the known thickness of the shadow mask and a known spacing. The adder also receives transducer inputs representative of measurements of the glass thickness, the distance of the shadow mask from a first reference plane and the distance of the panel from a second reference plane. The adder algebraically combines the stored and input data to yield an output representative of the Q spacing.

13 Claims, 1 Drawing Sheet

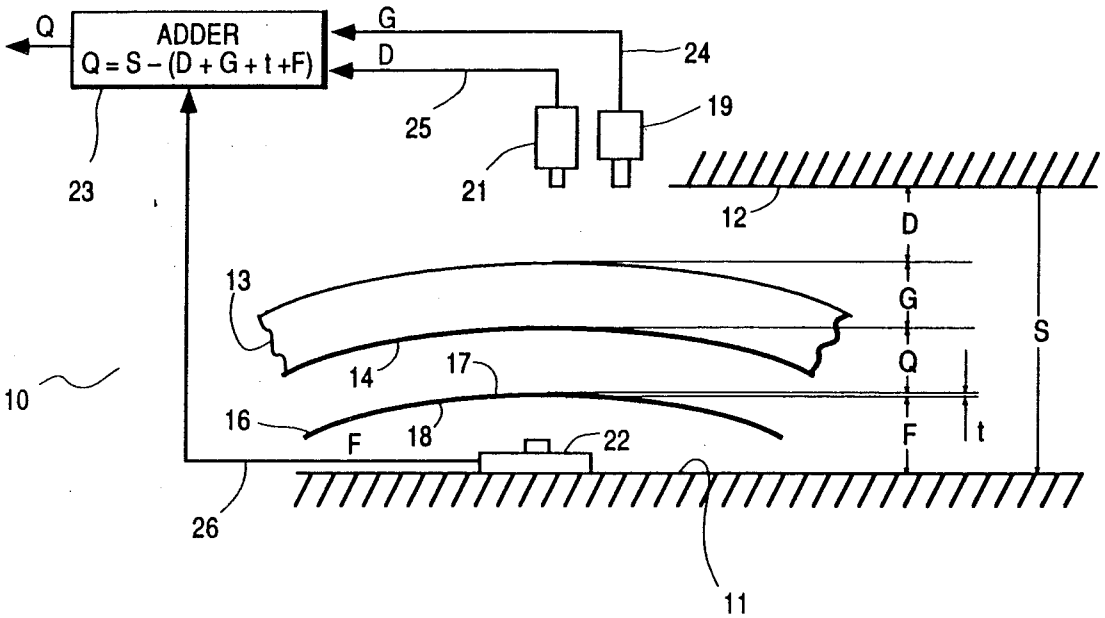
ADDER
Q = S − (D + G + t + F)
Q
G
D
24
25
19
21
23
12
S
D
G
Q
t
F
13
14
17
18
16
22
11
26
10

SYSTEM FOR MEASURING Q SPACING IN A KINESCOPE PANEL

BACKGROUND

This invention is directed to a system for measuring the Q spacing between the inside surface and shadow mask of a kinescope faceplate panel.

The screen of a color television picture tube is composed of three phosphors which individually emit red, green and blue light when impacted by electrons. Three electron beams individually energize the three phosphors to produce the desired color of light. The electron beams are caused to impact the desired light emitting phosphor by a color selection electrode, which is commonly called a shadow mask. The shadow mask is a thin metal electrode, which is biased at a high voltage to attract the electron beams, and includes a large number of small apertures through which the electrons pass prior to impacting the various phosphors. The electrons cross over while passing through the shadow mask apertures and in this manner are directed to the proper phosphor so that the "blue" electron beam impacts only the blue phosphor, etc. Because the electron beams cross one another, the spacing between the surface of the shadow mask and the phosphor screen is critical. This spacing is commonly called the Q spacing and must fall within a given range in order to insure that each electron beam impacts only the proper phosphor.

Because the Q spacing is critical in a panel it is common practice to measure the spacing to assure that it falls within the operative tolerance range prior to fully processing the panel and assembling the panel into a tube. Typically, in the prior art the Q spacing is measured by removing the shadow mask from the panel and placing a measuring device into the panel. The shadow mask is reinserted and causes readings on a number of gauges within the measuring device to measure the Q spacing at various locations along the surface of the panel to which the phosphor screen is subsequently applied. After the readings are taken, the shadow mask is removed to permit removal of the measuring device, after which the shadow mask is reinserted. This measuring technique is disadvantageous for several reasons. One of the more important reasons is the need to remove the shadow mask to allow insertion and removal of the measuring devices. Also, the measuring devices contact the surface of the shadow mask, frequently resulting in denting or scratching the fragile shadow mask. For these reasons there is a need for a system for measuring the Q spacing of a kinescope panel without the need for removing the shadow mask from the panel and without abrading the shadow mask to avoid all possibility of scratching or denting the shadow mask. The present invention fulfills these long-felt needs.

SUMMARY

A system for measuring the spacing Q between the screen side surface of a shadow mask and the inside surface of a kinescope faceplate panel includes an adder means for storing the thickness t of the shadow mask and the distance between first and second references planes, and for calculating the spacing in accordance with the stored and several measured inputs. A means for measuring the distance F between the first reference plane and the other surface of the shadow mask provides the distance F to the adder means. A means for measuring the thickness G of the panel provides the thickness G to the adder means. The adder means algebraically combines the distance and the thicknesses and provides the Q spacing.

BRIEF DESCRIPTION OF THE DRAWINGS

The FIGURE is a simplified showing of a preferred embodiment.

DETAILED DESCRIPTION

In the FIGURE, a system 10 for measuring the Q spacing between a shadow mask 16 and the inside surface 14 of a kinescope panel 13 includes a first reference plane 11 and a second reference plane 12 which are spaced by a known distance S. The glass panel 13 is shown broken away and the phosphor screen is subsequently affixed to the inside surface 14 of the glass panel 13. The panel 13 has a glass thickness G. The shadow mask 16 has a screen side surface 17 spaced the Q spacing away from the inside surface 14 of the panel. The shadow mask 16 has a known thickness t which is standard for many tube sizes. The other side 18 of the shadow mask 16 is spaced a distance F from the first reference plane 11. The outside surface of the panel 13 is spaced a distance D from the reference plane 12. An ultrasonic transducer 19 serves as a means for measuring the thickness G of the panel 13. The thickness G must be measured because of manufacturing tolerances of the panels. The ultrasonic transducer 19 is a type available in commerce, for example a model no. 5222 sold by Panametrics can be utilized. Another transducer 21 serves as a means for measuring the distance D between the reference plane 12 and the outside surface of the panel 13. The transducer 21 also is commercially available and can be a movable probe, or a linear differential transformer, or a CCD camera, all of which are readily available. Another transducer 22, which preferably is a CCD camera but which can be a probe or an ultrasonic measuring device, is used to measure the distance F between the inside surface 18 of the shadow mask 16 and the first reference plane 11. A storage/calculation means which preferably is a commercially available adder 23, receives the outputs of the transducers 19, 21 and 22 over lines 24, 25 and 26, respectively. The adder has been previously provided with the known parameters, which include the distance S between the reference planes 11 and 12, and the thickness t of the shadow mask 16. The thickness t of the shadow mask is known to be accurate within 0.001". This variation will have no appreciable affect on the accuracy of the Q space measurement and therefore the thickness t need not be measured. The adder 23 algebraically combines the stored and input data in accordance with the equation:

$Q = S = (D + G + t + F)$ where

Q = the spacing between the screen side surface 17 of the shadow mask 16 and the inside surface 14 of the panel 13.

S = the distance between reference planes 11 and 12.

D = the distance between the outside surface of the panel 13 and the reference plane 12.

G = the thickness of the glass.

t = the thickness of the shadow mask.

F = the distance between the inside surface 18 of the shadow mask 16 and the reference plane 11.

The output of the adder 23 thus is the Q spacing between the surface 17 of the shadow mask 16 and the inside panel surface 14, which is the desired quantity being measured. If the Q spacing falls outside a known operable range of permissible distances for the particular model and size of tube being measured, the color purity of a tube assembled with the panel would be unacceptable and therefore the panel is rejected.

Typically the Q spacing of a panel is measured at a plurality of locations. Accordingly, although it is not shown in the drawing, some provision, such as cylinders or stepping motors, can be used to move the panel 13 and the shadow mask 16 assembly with respect to the transducers 22, 21 and 19 to obtain separate Q spacing measurements for a plurality of individual locations. The failure of the Q spacing to be within the permissible range for any one of the measuring locations will result in the rejection of the panel because it would indicate that at least one small area of the panel would have improper color purity and thus be objectionable.

WHAT IS CLAIMED IS:

1. A system for measuring the spacing Q between the screen side surface of a shadow mask and the inside surface of a kinescope faceplate panel comprising:

adder means for storing the thickness t of said shadow mask and the distance between first and second reference planes, and for calculating said spacing in accordance with measured inputs;

means for measuring the distance F between said first reference plane and the other surface of said shadow mask and for providing said distance F to said adder means as one of said measured inputs;

means for measuring the thickness G of said panel and for providing said thickness G to said adder means as another of said measured inputs, said adder means algebraically combining said distance and said thicknesses and providing said Q spacing.

2. The system of claim 1 wherein said reference planes are separated by a fixed distance S.

3. The system of claim 2 wherein said distance F is measured using a CCD camera.

4. The system of claim 3 wherein said thickness G is measured using an ultrasonic transducer.

5. The system of claim 4 wherein the distance D between said second reference plane and said panel is measured using a probe.

6. The system of claim 2 wherein said distance F is measured using a probe.

7. The system of claim 6 wherein said thickness G is measured using an ultrasonic transducer.

8. The system of claim 7 wherein the distance D between said second reference plane and said panel is measured using a CCD camera.

9. A system, having first and second reference planes, for measuring the Q spacing between the screen side surface of a shadow mask and the inside surface of a kinescope faceplate panel in accordance with the expression $Q=S-(D+G+t+F)$, where:

S = the distance between said reference planes

D = the distance between the outside surface of said panel and said second reference plane G = the thickness of said panel t = the thickness of said shadow mask F = the distance between the inside surface of said shadow mask and said first reference plane said system comprising:

first means for measuring said distance D; second means for measuring said thickness G; third means for measuring said distance F; and storage/calculation means for storing said distance S and said thickness t and for receiving said distance D, said thickness G and distance F and for calculating said Q spacing in accordance with said expression.

10. The system of claim 9 wherein said thickness G is measured using an ultrasonic transducer.

11. The system of claim 10 wherein said distance F is measured using a CCD camera.

12. The system of claim 11 wherein said distance D is measured using a probe.

13. The system of claim 9 wherein said distance F is measured using a probe.

* * * * *